United States Patent [19]

Usuiwa et al.

[11] Patent Number: 4,777,733

[45] Date of Patent: Oct. 18, 1988

[54] METHOD OF MANUFACTURING SHOES

[75] Inventors: Mikio Usuiwa, Matsudo; Masanobu Shinkai, Tokyo; Chisato Fujishima, Matsudo, all of Japan

[73] Assignees: Iwatani & Co. Ltd., Osaka; Chiba Iwatani Kosan Kabushiki Kaisha, Chibaken, both of Japan

[21] Appl. No.: 1,453

[22] Filed: Jan. 8, 1987

[51] Int. Cl.[4] ..... F26B 5/00

[52] U.S. Cl. ..... 34/20; 12/54.1; 12/53.1; 62/374

[58] Field of Search ..... 34/20; 62/374; 12/54.1, 12/54.2, 54.3, 53.1, 1 A

[56] References Cited

U.S. PATENT DOCUMENTS

| | | | |
|---|---|---|---|
| 2,781,533 | 2/1957 | Quinn | 12/54.2 |
| 3,220,033 | 11/1965 | Bromfield et al. | 12/1 A |
| 4,304,020 | 12/1981 | Bonnet et al. . | |
| 4,422,198 | 12/1983 | Bichet | 12/54.3 |
| 4,528,710 | 7/1985 | Simmonds et al. . | |
| 4,589,264 | 5/1986 | Astrom | 62/374 |
| 4,627,244 | 12/1986 | Willhoft | 62/374 |

*Primary Examiner*—Larry I. Schwartz

*Attorney, Agent, or Firm*—Foley & Lardner, Schwartz, Jeffery, Schwaab, Mack, Blumenthal & Evans

[57] ABSTRACT

In a method of manufacturing shoes, shoes which are integrated by securing bottoms to ones assembled by joining the edges of uppers and insoles fitted to shoe lasts, are taken in a rapid freezing atmosphere cooled by liquefied gas, in which the surfaces thereof are cooled rapidly. The effect of rapid cooling makes it possible to manufacture shoes which maintain their shape when fitted in correspondence to the shoe lasts without causing any disfigurement thereafter as well as shortening the manufacturing time.

13 Claims, 2 Drawing Sheets

Temperature of workshop
(Normal temperature about 20°C)

| Specimen NO. | | Cooling Time | Room Temp. | Use of Fan | Temp. of Shoes Surfaces Before Cooling | Temp. of Shoes Surfaces After Cooling | Number of Disfigured Ones ◎ | ○ | △ | × |
|---|---|---|---|---|---|---|---|---|---|---|
| Present Inv. | 1 | 2 mins. 30 secs. | -50°C | Off | +23°C | +7°C more than | 2 | 18 | — | — |
| | 2 | | -80°C | | +23.6°C | -3.6°C more than | 8 | 12 | — | — |
| | 3 | | -100°C | | -34°C | -16°C more than | 7 | 13 | — | — |
| | 4 | 1 min. 20 secs. | -50°C | On | +26.7°C | +5.5 to +6.1°C | 5 | 15 | — | — |
| | 5 | | -80°C | | +25°C | -2.8 to -5.6°C | 14 | 6 | — | — |
| | 6 | | -100°C | | +25.5°C | -3.7°C more than | 20 | — | — | — |
| Prior Art | | ——— | | | | | — | 6 | 14 | — |

Fig. 3

Temperature of workshop
(Normal temperature about 20°C)

| Specimen NO. | | Cooling Time | Room Temp. | Use of Fan | Temp. of Shoes Surfaces | | Number of Disfigured Ones | | | |
|---|---|---|---|---|---|---|---|---|---|---|
| | | | | | Before Cooling | After Cooling | ◎ | ○ | △ | × |
| Present Inv. | 1 | 1min. 40 secs. | -100°C | On | 24 to 26°C | -2.0 to -3.0°C | 19 | 1 | — | — |
| | 2 | | | | | -2.5 to -3.2°C | 20 | — | — | — |
| | 3 | 2mins. | | | | -3.0 to -3.8°C | 18 | 2 | — | — |
| | 4 | | | | | -3.0 to -3.7°C | 19 | 1 | — | — |

Fig. 4

Temperature of workshop
(Normal temperature about 20°C)

| Specimen NO. | | Cooling Time | Room Temp. | Use of Fan | Temp. of Shoes Surfaces | | Number of Disfigured Ones | | | |
|---|---|---|---|---|---|---|---|---|---|---|
| | | | | | Before Cooling | After Cooling | ◎ | ○ | △ | × |
| Present Inv. | 1 | 1min. 30 secs. | -100°C | On | 23 to 25°C | -2.0 to -3.5°C | 17 | 3 | — | — |
| | 2 | | | | | -2.0 to -3.5°C | 20 | — | — | — |
| | 3 | | -120°C | | | -3.7 to -6.0°C | 18 | 2 | — | — |
| | 4 | | | | | -3.7 to -6.0°C | 17 | 3 | — | — |

METHOD OF MANUFACTURING SHOES

BACKGROUND OF THE INVENTION

1. Field of the Invention

The present invention relates to the field of shoe-making, and more particularly to the method of manufacturing shoes, wherein a shoe assembled integrally with all parts thereof bonded and joined on a last is conveyed to a rapid-freezing apparatus in which the shoe is cooled rapidly by means of liquefied gas so as to obtain a shoe fitted exactly to the last and to manufacture the shoe, the commercial value being enhanced, in a short time and highly efficiently in a semiautomated or an entirely automated shoe-manufacturing process.

2. Prior Art

As for a prior shoe manufacturing method, a direct-binding manufacturing method (cemented manufacturing method) is known in the art. Although the parts differ a little according to the kinds of shoes, the manufacturing method for the standard type of shoes will be explained as a typical example. In the prior manufacturing method, first of all the uppers which are assembled from the toe-caps, the right and left sides and the boxings (back parts of the shoes) cut out according to their respective proper configurations and the insoles are pressed onto the shoe lasts. At the same time, those uppers and soles are lasted each other exactly on the peripheries of the lasts by means of tacking and/or gluing their overlapped edges and then are joined integrally by means of heat-setting. After that, the bottoms of the shoes are secured to the undersides of said lasted soles by means of gluing and pressing and then the heels thereof are secured to the bottoms accordingly. At the final finishing step, the enamel or the varnish for shoes is sprayed onto the outside surfaces of said joined shoes by means of spray gun.

On the other hand, even though the commodity value for the shoes is estimated from general point of view, actually it greatly depends on the finishing condition of the shoe surfaces and shapes. Accordingly, the following conditions are essential for the enhancement of the commodity value for the shoes. That is, (1) the shoes surfaces should be smooth. (2) And the uppers should be gotten into "habits" so as to retain the shapes in accordance with the lasts. That is, (2-a) the top-lines of the shoes should be formed proportionally so as to keep them in shape. (2-b) And the shapes of the shoes should be kept correctly without being shrunk or wrinkled, especially so as to properly maintain the correct shaped contours of the toe-caps.

However, in said prior manufacturing method, the temperature of the shoe surfaces rises to 65°~70° C. for the heat-setting, and said surfaces are still kept at such hot temperature as 25°~35° C. at the end of the bottom press-securing step. Hence, in the case where the lasts are removed from the shoes just after the bottom securing, the commodity value thereof is apt to be diminished greatly because the shoes get out of shape until shipping.

Therefore, in order to prevent such a disfigurement as above-mentioned, as shown in U.S. Pat. No. 4,304,020 and U.S. Pat. No. 4,528,710, it is necessary to have such a finish step because the shoes are allowed to stand for a certain time and cool down naturally at room temperature or to be cooled gradually by supplying cold air thereto between said bottom securing step and the last removal step and then the shoes from which the lasts are removed are also allowed to stand undisturbed in storage.

However, in the known method as shown in said prior art, it needs a long time for the shoes to cool down because the finish step is carried out with a slow way of cooling down, and during that time a physical change is apt to take place in a certain quality of leather so as to cause a disfigurement in a portion of the shoes which may diminish the commodity value and must be corrected later.

Further, as shown in the above-mentioned prior art, in a general shoe manufacturing method there is provided a conveyer line which covers a through process from the assembly step to the finish step. For example, in said cemented method, since the rate taken by the line for the steps following the finish step relative to the entire manufacturing line is comparatively large and the cooling time is protracted due to the slow cooling down, disadvantageously the manufacturing efficiency is lowered according to the protracted time and the entire manufacturing line is scaled up according to the extended line for the steps following the finish step.

Furthermore, since more lasts are needed in proportion to the extended manufacturing time and line, the turnover rate of the last utilization is lowered accordingly. Owing to the delay of the finishing work which might influence the stabilizing time succeedingly and the stabilizing time which must be long enough to make the shoe shape stabilized, it takes too many days from manufacturing to shipping.

SUMMARY OF THE INVENTION

The present invention is directed to solving the problems noted above, and has for its objects to restrain the shoes from being disfigured and to enhance the efficiency of the finishing work.

The applicant of the present invention has developed the novel and improved shoe manufacturing method based on the discovery that a physical change shoe leather, that is a shrinkage or a tendency such as a restoration to a peculiarity originally possessed by the shoe leather, is restrained at an early stage so as to prevent a so-called "getting-lean" phenomenon by means of a rapid cooling of shoes assembled by setting up of uppers and securing of bottoms.

Accordingly, the features of the present invention reside in solving the above-mentioned problems and restraining the shoe disfigurement by the finishing work wherein the shoes, assembled by setting up of uppers and securing of bottoms, are cooled rapidly by means of liquefied gas such as liquid nitrogen and the like in a rapid freezing apparatus located near the end of the shoe manufacturing line instead of natural cooling down or slow cooling down, and after that the frosty surfaces thereof are wiped for vanish to be applied thereto by means of a spray gun, and then the lasts removal is carried out.

Present invention can be applied to the shoe manufacturing method such as the Goodyear method, the Macca method, the out-stitch method and the injection method, and so on besides said cemented method. Further, in the present invention both a natural leather and a synthetic leather can be utilized for uppers and bottoms of shoes. And preferably said rapid cooling of the shoes is carried out in such a way that the shoes are conveyed into a tunnel-shaped rapid freezing room located in a part of the shoe manufacturing line for the surface thereof to be applied with the liquefied gas such as liquid nitrogen, liquid carbon dioxide, liquid air and liquid argon. Furthermore, as shown in an experiment embodiment described later, it is preferable that the shoes are cooled at the temperature of −50°~−120° C. during the time of 1 min. 20 secs.~2 mins. 30 secs. in order to restrain the shoes from disfiguring or to limit their disfigurement to the minimum.

A principal advantage of the present invention is that it provides a method of manufacturing shoes wherein a physical change of shoe leather, for example a shrinkage of the leather and the like can be restrained at an early stage by the finishing work including a rapid cooling of shoes. Hence, the commodity value of the shoes is enhanced because the top-lines, the shaped contours of toecaps and the uppers are kept in shape corresponding to the lasts for a disfigurement thereof to be prevented by restraining the restorative action of the leather. And also the shape of the shoes can be stabilized in a shorter time because it is not necessary to have such a long time as that in the prior method for the shape stabilization.

Another advantage of the present invention is that it provides a method of manufacturing shoes wherein the efficiency of the finishing work can be enhanced by the cooling time being shortened owing to the rapid cooling thereof. At the same time, the shoe manufacturing line can be made more compact by shortening the line following the finish step.

Yet another advantage of the invention is that it provides a method of manufacturing shoes wherein the turnover rate of the last utilization can be raised because the number of the lasts required in the line is decreased due to shortening of the line following the finish step.

Accordingly, for example in the case where shoes are manufactured by the cemented method, the method of the present invention can cut down both the cooling time for finishing and the stabilizing time and accordingly shorten the days required between manufacturing to shipping by about half in comparison with the prior method wherein the time required between the finishing work including the shoes cooling to the cooling down for the shoes stabilizing at a room temperature is as long as taking about half of the entire manufacturing time.

The foregoing and other objects and attendant advantages of the present invention will be readily appreciated as the same becomes better understood by reference to the following detailed description when considered by the accompaning drawings, wherein:

BRIEF DESCRIPTION OF THE DRAWINGS

FIG. 1 is a schematic explanatory representation of a liquid nitrogen type of rapid freezing apparatus according to the present invention; and FIG. 2 through FIG. 4 are comparative tables showing the finish results of shoes rapid cooling.

DESCRIPTION OF THE PREFERRED EMBODIMENTS

Figures 1, 2:
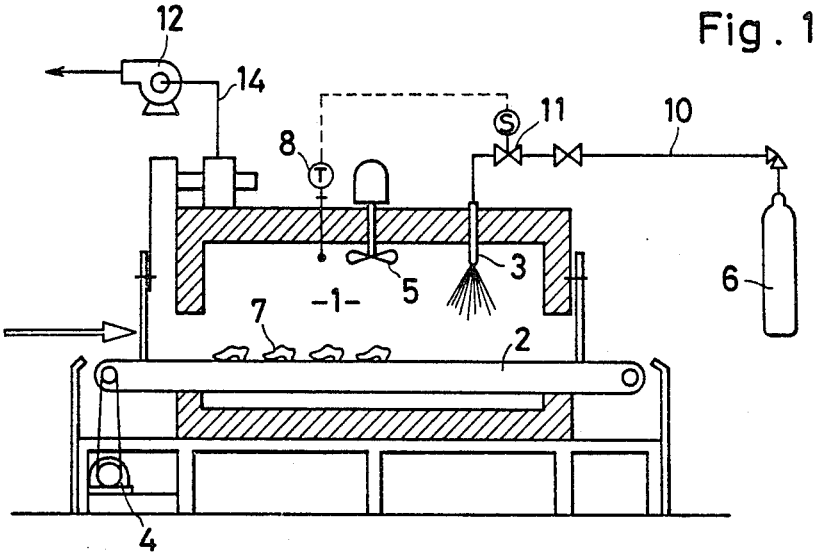

At first, an outline of a finishing work apparatus for use in a method of the present invention is explained referring to FIG. 1. As shown in FIG. 2 through FIG. 4, the temperature changes of shoe surfaces and the quality of shoes are examined in the following rapid cooling tests with use of the apparatus.

The environmental temperature of the workshop is a normal temperature (about 20° C.).

In FIG. 1 showing a liquid nitrogen type of tunnel-shaped rapid freezing apparatus, the rapid freezing apparatus comprises a tunnel-shaped room 1, a bar type of conveyor 2 provided transversely at the central portion thereof and a spray nozzle 3 projected inwardly from the top wall thereof for injecting liquid nitrogen gas.

The conveyer 2 is adapted to be driven at a revolution speed by means of a geared motor 4 and supports a plurality of shoes 7 assembled from uppers and bottoms on shoe lasts by means of a known automatic shoe manufacturing machine to convey them into the tunnel-shaped room 1.

The liquid nitrogen gas is adapted to be supplyed from a nitrogen gas source 6 so as to be sprayed into the room 1 through the nozzle 3 and dispersed uniformly in the room 1 by a fan 5 in order to lower the room temperature and rapidly cool the shoes 7 on the conveyer 2.

By the way, the interior of the tunnel-shaped room 1 is kept at a constant temperature by always detecting a change of the room temperature through a sensor 8 and controlling a quantity of the nitrogen gas injected from the nozzle 3 through a solenoid valve 11 provided in a nitrogen gas supply line 10 so as to link to the sensor 8. And the nitrogen gas exhausted for cooling of the shoes is adapted to be discharged to the outside of the apparatus through an exhaust line 14 by means of an exhaust fan 12.

<Finish Work Test-1>

This finish work test is carried out in such a way that the shoes brought to completion by bottom securing are cooled rapidly on way of conveyance through said liquid nitrogen type of rapid freezing apparatus.

In this test, three steps of room temperature and conditions such as long and short durations of cooling, as well as usage and non-usage of fan in relation to the respective room temperature, are previously set. Under those conditions, the temperature change of shoe surfaces and the shape of shoes are investigated with about twenty shoes being grouped respectively in each test condition.

In the test for checking disfigurement of shoes, every group of shoes is evaluated by comparing with the following four kinds of models previously set by the skilled persons in this art after completion of such sequential work as a finishing work of shoe cooling, wiping up frost thereon, removing lasts therefrom and leaving them undisturbed in a storage for three days.

The four kinds of models are sorted to the following four grades respectively. That is, the symbol indicates the best state of shoes which have totally no wrinkles and no disfigurements caused around their toplines and the contours of their toecaps. The symbol indicates the good state of shoes which maintain beautiful shape in spite of having a little lack of smoothness, but inconspicuously in the contours thereof. The symbol Δ indicates a little bad state of shoes which have little conspicuous wrinkles and not a little disfigurements. The symbol x indicates the bad state of shoes which have serious disfigurement and is badly out of shape in comparison to the shoe last.

On the other hand, for the comparison with the results by the present invention there is provided the results by the prior art in which twenty shoes of moccasin type are cooled down gradually for 35 mins. and then allowed to stand undisturbed for stabilization during three days in a storage. These shoes are sorted in the table FIG. 2 in comparison with said four models.

As shown in FIG. 2, when the finishing method of the present invention is applied to shoes specimens (twenty pieces x six conditions), all shoes are kept to be best or good state.

Especially, the test results become better as the room temperature becomes lower (−50° C. to −100° C.) under the same cooling time and also as the cooling time becomes shorter (2 mins. 30 secs. to 1 min. 20 secs.) under the same room temperature. Further, the test results become better as the fan is utilized under the same cooling time and the same cooling temperature. As for the typical example, there are caused no disfigurements in the shoes of No. 6 specimen under the condition that the room temperature is −100° C., the cooling time is 1 min. 20 secs. and the fan is utilized.

In contrast therewith, in the test result by the prior method the rate for the good state of shoes is confined only to 30%, and that for the best state of shoes is 0%.

<Finish Work Test-2>

Since the best result can be obtained at the room temperature of −100° C. according to said Test-1, this test for checking disfigurements of shoes is carried out in the condition that two kinds of cooling times, one is 1 min. 40 secs. and the other is 2 mins., are applied respectively to two groups of boots (one group including twenty shoes) under that room temperature.

As shown in FIG. 3, it is reaffirmed that the better results can be obtained as the cooling time becomes shorter under the same room temperature.

<Finish Work Test-3>

Since better results can be obtained as the cooling time becomes shorter according to said Test-2, this test for checking disfigurements of shoes is carried out under the condition that two steps of room temperatures, one is −100° C. and the other is −120° C., are applied respectively to two groups of shoes (one group including twenty shoes) under the cooling time of 1 min. 30 secs.

As shown in FIG. 4, in the case of the room temperature being −120° C. the rate for the best state of shoes gets less than that in the case of the room temperature being −100° C.

Accordingly, around −100° C. is thought to be suitable for the finishing work by a rapid cooling.

<Finish Work Test-4>

When making a comparison between the soft leather shoes shipped after an application of the rapid cooling finish of the present invention and the shoes shipped after an application of the slow cooling finish of the prior art, it can be understood that the shoes according to the present invention have no disfigurement after and the half of the shoes according to the prior art start to cause disfigurements with the lapse about two weeks.

Accordingly, since the present invention also can be applied to soft leather shoes without causing any disfigurement after shipping, the present invention can save the time and labor for keeping them in storage during about two weeks in order to check for the presence of disfigurement thereof as well as saving the space for storage needed in the prior art.

As above-mentioned, since the present invention is intended to restrain physical changes of the shoe leather by the rapid cooling finish, it can be applied to not only natural leather shoes but also synthetic leather shoes, further to general leather goods such as clogs like slippers except shoes, bags, handbags, baskets, belts and gloves so as to obtain good results.

Moreover, the above-mentioned cooling temperature in the rapid freezing apparatus is one set up under the condition that the temperature of the working environment is around 20° C. as an usual temperature. Therefore, in the case, even though it is a rare case, that the finish work of the rapid cooling is carried out in a severe cold (such as 0° C.) or a very hot (such as 40° C.) working environment, the cooling temperature may be extended to such a wide applicable range as its upper limit temperature is −30° C. and its lower limit temperature is −150° C.

It is submitted, that the appended claims are to be interpreted as exemplary only, and not in a limiting sense.

We claim:

1. The method of manufacturing shoes and the like wherein bottoms are secured to lasted soles and uppers, comprising rapidly cooling the shoes to prevent disfigurement by placing the shoes in an apparatus and directing liquified gas therein.

2. A method of manufacturing shoes according to claim 1, wherein said liquefied gas is liquid nitrogen.

3. A method of manufacturing shoes according to claim 1, wherein said liquefied gas is liquid carbon dioxide.

4. A method of manufacturing shoes according to claim 1, wherein said liquefied gas is liquid air.

5. A method of manufacturing shoes according to claim 1, wherein said liquefied gas is liquid argon.

6. A method of manufacturing shoes according to claim 1, wherein said rapid cooling is carried out by injecting liquefied gas into the apparatus and dispersing it therein so as to uniformalizing the temperature of cooling atmosphere in the apparatus.

7. A method of manufacturing shoes according to claim 6, wherein a rapid cooling is carried out under the condition that the temperature in the rapid freezing apparatus is set at −50° C. to −120° C. and the cooling time is set to 1 min. 20 secs. to 2 mins. 30 secs.

8. The method of claim 1 wherein the temperature in the apparatus during cooling is between about −50° C. and −120° C. and the cooling time is between about 1 minute, 20 seconds and 2 minutes, 30 seconds.

9. The method of claim 8 wherein the temperature is about −100° C. and the cooling time is about 1 minute, 30 seconds.

10. The method of claim 1 wherein the temperature in the apparatus is at least about 70° C. below the temperature of the environment around the apparatus.

11. The method of manufacturing shoes and the like wherein bottoms are secured to lasted soles and uppers, comprising rapidly cooling the shoes to prevent disfigurement by spraying a liquified gas on the shoes.

12. The method of claim 11 including uniformly dispersing the liquified gas around the shoes.

13. The method of manufacturing shoes and the like wherein bottoms are secured to lasted soles and uppers, comprising rapidly cooling the shoes to prevent disfigurement, and wherein the temperature of the before cooling is between about 23° C. and 26° C. and after-cooling between about −2° C. and −6° C.

* * * * *